US010597250B2

(12) United States Patent
Elliott

(10) Patent No.: US 10,597,250 B2
(45) Date of Patent: Mar. 24, 2020

(54) ELASTIC HAIR TIE DISPENSER

(71) Applicant: TIY Products, LLC, Austin, TX (US)

(72) Inventor: Jerritt K. Elliott, Austin, TX (US)

(73) Assignee: TIY Products, LLC, Austin, TX (US)

( * ) Notice: Subject to any disclaimer, the term of this patent is extended or adjusted under 35 U.S.C. 154(b) by 0 days.

(21) Appl. No.: 16/000,827

(22) Filed: Jun. 5, 2018

(65) Prior Publication Data

US 2018/0354740 A1 Dec. 13, 2018

Related U.S. Application Data

(60) Provisional application No. 62/516,464, filed on Jun. 7, 2017.

(51) Int. Cl.
*B65H 35/00* (2006.01)
*A45D 8/34* (2006.01)

(52) U.S. Cl.
CPC ..... *B65H 35/0086* (2013.01); *B65H 35/002* (2013.01); *A45D 8/34* (2013.01)

(58) Field of Classification Search
CPC ..... B65H 35/0086; B65H 35/002; A45D 8/34
USPC ..... 225/43
See application file for complete search history.

(56) References Cited

U.S. PATENT DOCUMENTS 2,452,584 A * 11/1948 Luebkeman ..... B65H 35/0033 156/523
5,080,270 A * 1/1992 Kai ..... A47F 13/045 225/52
5,133,980 A * 7/1992 Ream ..... B65H 35/002 206/409
5,172,841 A * 12/1992 Friedman ..... A47F 13/045 225/42
5,280,741 A * 1/1994 Bell ..... A61C 9/0033 225/6
5,524,843 A 6/1996 McCauley
5,582,041 A 12/1996 Spiess
6,095,323 A * 8/2000 Ferguson ..... A61B 17/06123 206/204
6,161,288 A 12/2000 Andrews
6,386,416 B1 5/2002 Dunshee et al.
6,457,665 B1 10/2002 Koehler, Sr. et al.
6,557,262 B1 5/2003 Clemence et al.
6,616,360 B2 9/2003 Lehmkuhl
(Continued)

OTHER PUBLICATIONS

Tactical Rope Dispenser—TRD by Atwood Rope MFG; Oct. 19, 2016; retrieved from https://www.youtube.com/watch?v=KVvg1ev-5Tw on Aug. 2, 2018.

*Primary Examiner* — Omar Flores Sanchez
(74) *Attorney, Agent, or Firm* — Joseph K. Liu; One LLP

(57) ABSTRACT

The present invention provides an elastic hair tie material and an elastic hair tie dispenser for dispensing varying lengths of elastic hair tie material. More particularly, the present Elastic Hair Tie Dispenser device has been configured with a flexible cover, a pivoting cutting blade actuator and cutting blade to conveniently dispense elastic hair tie material of varying color, cut to any desired length by the user of the dispenser, to be worn by women or men to restrain their hair in many varying different stylish configurations and for varying purposes, and wherein the dispenser is refillable by either winding hair tie material onto a spool rotatably housed within the dispenser or inserting a new coil of hair tie material sold separately.

16 Claims, 7 Drawing Sheets

(56) References Cited

U.S. PATENT DOCUMENTS

| | | | | |
|---|---|---|---|---|
| 6,694,667 | B2 * | 2/2004 | Davis | A01K 97/06 225/47 |
| 7,641,087 | B2 * | 1/2010 | Chang | B65H 35/0026 225/43 |
| 8,047,461 | B1 | 11/2011 | Slawson | |
| 8,083,114 | B1 | 12/2011 | Steele et al. | |
| 8,602,280 | B2 * | 12/2013 | Chang | B26F 3/02 225/43 |
| 9,032,629 | B2 * | 5/2015 | Bermes | B26B 27/00 30/127 |
| 10,099,394 | B2 * | 10/2018 | Bermes | B26B 27/00 |
| 2006/0118589 | A1 * | 6/2006 | Arnarp | B65H 35/002 225/43 |
| 2008/0105723 | A1 * | 5/2008 | Chang | B65H 35/0026 225/47 |
| 2015/0164195 | A1 | 6/2015 | Elliott | |
| 2018/0000204 | A1 * | 1/2018 | Ingimundarson | A44C 5/003 |

* cited by examiner

ELASTIC HAIR TIE DISPENSER

FIELD OF THE INVENTION

The present invention provides an elastic hair tie material and an elastic hair tie dispenser for dispensing varying lengths of elastic hair tie material. More particularly, the present Elastic Hair Tie Dispenser device has been configured with a flexible cover, a pivoting cutting blade actuator and cutting blade to conveniently dispense elastic hair tie material of varying color, cut to any desired length by the user of the dispenser, to be worn by women or men to restrain their hair in many varying different stylish configurations and for varying purposes, and wherein the dispenser is refillable by either winding hair tie material onto a spool rotatably housed within the dispenser or inserting a new coil of hair tie material sold separately.

BACKGROUND OF THE INVENTION

For many years the common rubber band has been the means for a person with long hair of holding it back in a ponytail away from their face. The problem with rubber bands is that they tend to break or damage the hair. Other items that are commonly used are scarfs and items that have been developed into a means of adornment like colorful fashion accessories. Presently more women as well as men have a need to hold their hair back to keep it out of their face. In many cases, there is an occupational necessity, such as in food servers, machine operators and athletes.

The elastic hair ties that can be found on the market today are very generic in their construction and design and do not effectively address the needs of the consumer. The majority of the designs on the market are a "one size fits all" product. Other companies have brought to the market elastic hair ties that are sized based on a criterion of age. Generally, they are made in adult or child's size. As a result, these products do not address the actual thickness of texture of an individual's hair. This does not allow the user to have a product that is more suited for their needs.

The products currently on the market are inexpensive and do not perform well or last very long due to basic problems with the quality of the material used in the construction. In order to keep prices low, the elastic material used is inferior and has a very short life span, both from retention of elasticity and breakage standpoint. A basic design flaw is a built-in weakness in the product where a metal "crimp" is used to attach two ends of the hair tie together that creates a point of failure when used repeatedly.

Numerous innovations for hair ties have been provided in the prior art that are described as follows. Even though these innovations may he suitable for the specific individual purposes to which they address, they differ from the present invention as hereinafter contrasted. The following is a summary of those prior art patents most relevant to the invention at hand, as well as a description outlining the difference between the features of the present invention and those of the prior art.

US Patent Application Publication No. US 2009/0178690 A1 of William John Olson is directed to a hair tie, having an elastic member extendable toward opposing ends and complementary fasteners located at least two portions of the elastic member. Optionally, the invention may include an ornament holder, having a fastener configured to removably attach to an elastic member.

This patent describes a hair tie only, having an elastic member extendable toward opposing ends and complementary fasteners but does not have the capabilities of dispensing varying color elastic hair tie material to be cut to different length for varying purposes of hair restraint and decoration.

US Patent Application Publication No. US 2013/0263884 of Mariana Hogan et al. describes a ponytail cover that includes an elastic band extending between first and second free ends. Fastening portions such as Velcro portions or hooks are positioned at the first and second free ends of the elastic band and can be fastened together so as to form the elastic band into a loop to cover a ponytail holder. Strips of hair extend over and substantially cover a surface of the elastic band that is outwardly facing when formed into the loop. A ponytail holder includes a band of hair extending between first and second free ends and hooks attached to the first and second free ends can be fastened together to secure the ponytail holder when the band of hair is wrapped around a ponytail.

This patent describes a ponytail cover that includes an elastic band but does not deal with the hair tie and does not have the capabilities of dispensing varying color elastic hair tie material to be cut to different length for varying purposes of hair restraint and decoration.

US Patent Application Publication No. US 2011/0048450 of Kai-Mou Tsia A hair binder for arranging the hair is disclosed to include an elastic cord member, a clamp affixed to the elastic cord member to join the ends of the elastic cord member, and a flexible protective sleeve covering the clamp and carrying a design.

This patent describes a hair binder for arranging the hair as a unique hair tie only, but does not have the capabilities of dispensing varying color elastic hair tie material to be cut to different length for varying purposes of hair restraint and decoration.

U.S. Pat. No. 7,305,996 of Sarah Kraft et al. describes an elastic band that includes an elongate elastic core, a sheath, and an elongate friction member. The elongate elastic core comprising a continuous loop and the sheath has an outer surface and surrounds the elongate elastic core. The elongate friction member is disposed in the sheath, such that at least a portion of the elongate friction member protrudes past the outer surface of the sheath.

This patent describes an elastic band that includes an elongate elastic core, a sheath, and an elongate friction member but does not have the capabilities of dispensing varying color elastic hair tie material to be cut to different length for varying purposes of hair restraint and decoration.

U.S. Pat. No. 6,182,672 of Feliz R. Abasta-Douglas et al. describes a looped fastener having a fabric covered elasticized member having a thin, substantially rectangular cross-sectional configuration having terminal ends formed in a loop by passing the elasticized member through a hollow open ended decorative body. The looped fastener is tightened and loosened by moving the open-ended body up and down the fabric covered elasticized member. The smaller the loop, the tighter the fasten. The larger the loop the looser the fasten. Secondary open-ended bodies affixed to the terminal ends of the fabric covered elasticized member prevent the elasticized member from accidentally being pulled out of the aforementioned open-ended body.

This patent describes a looped fastener having a fabric covered elasticized member having a thin, substantially rectangular cross-sectional configuration but does not have the capabilities of dispensing varying color elastic hair tie material to be cut to different length for varying purposes of hair restraint and decoration.

U.S. Pat. No. 6,047,708 of Sherelle I. Pannel et al. describes a hair bun kit and process which allows a hair bun to be easily and quickly formed. The hair bun kit consists of a first resilient hairband, a second resilient hairband and a hair bun mold having a centered opening, an upper surface and a lower surface. An optional ornamental hairband may also be included to enhance the aesthetics of the hair bun. To use the hair bun kit the first resilient hairband is tightly wrapped around a bundle of hair strands. The secured hair bundle is then inserted through the centered opening and the hair strands are draped over the upper surface of the mold. The second resilient hairband is placed over the draped hair strands and around the lower surface of the hair bun mold to secure the hair strands. The ornamental hairband is then placed around the lower surface of the hair bun mold to complete the hair bun.

This patent describes a hair bun kit and process which allows a hair bun to be easily and quickly formed but does not have the capabilities of dispensing varying color elastic hair tie material to be cut to different length for varying purposes of hair restraint and decoration.

U.S. Pat. No. 5,456,274 of Kathie Selbee et al. describes a removable cover for a hair band that has a fabric tube with first and second ends, the fabric tube having a longitudinally elasticized seam between the first and second ends whereby the cover is removably mountable on the hair band by sliding the fabric tube over the hair band so as to place the seam along an inside surface of the hair band.

This patent describes a removable cover for a hair band that has a fabric tube but does not have the capabilities of dispensing varying color elastic hair tie material to be cut to different length for varying purposes of hair restraint and decoration.

U.S. Pat. No. 3,832,841 of Bernard M. Cole describes an ornamental expansible strip for use as a yarn stretch gift packages tie and as a decorator hair tie, and the method of making the same. The expansible strip comprises an elastic core under a retained low stretch and an ornamental yarn cover embracing the same, the yarn cover comprising yarn strands which are stretched and coiled about in the same direction and on opposite side of the elastic core, the core and yarn cover combinedly possessing a stable twist, the yarn being tightly wound, and locked to the stretched and twisted elastic core.

This patent describes an ornamental expansible strip for use as a yarn stretch gift packages tie and as a decorator hair tie but does not have the capabilities of dispensing varying color elastic hair tie material to be cut to different length for varying purposes of hair restraint and decoration.

None of these previous efforts, however, provides the benefits attendant with the Elastic Hair Tie Dispenser.

The present application provides for an Elastic Hair Tie Dispenser and describes a new and unique means of dispensing replaceable elastic cording within a fabric sleeve, coming in a variety of different colors to be cut to any desired length for restraining the hair or used in a variety of different stylish hair configurations.

In this respect, before explaining at least one embodiment of the Elastic Hair Tie Dispenser in detail it is to be understood that the design is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

SUMMARY OF THE INVENTION

The principal advantage of the Elastic Hair Tie Dispenser is to readily dispense the unique replaceable elastic cording within a fabric sleeve, coming in a variety of different bright colors, and cut to any length desired by the user, for hair restraint.

Another advantage of the Elastic Hair Tie Dispenser is that it is small enough to be held in the palm of the hand.

Another advantage of the Elastic Hair Tie Dispenser is that it can cut the replaceable elastic cording to different lengths.

Another advantage of the Elastic Hair Tie Dispenser is that you can, by holding the device in the palm of the hand and pressing with the thumb cut the cording.

Another advantage of the Elastic Hair Tie Dispenser is that it is transparent, so the different colors of the elastic cording are visible.

Another advantage of the Elastic Hair Tie Dispenser is that it can be taken apart to refill, or to change the color of the elastic cording.

Another advantage of the Elastic Hair Tie Dispenser is that it can be sold as a sealed disposable unit or sold as a refillable unit.

These together with other advantages of the Elastic Hair Tie Dispenser, along with the various features of novelty which characterize the design, are pointed out with particularity in the claims annexed to and forming a part of this disclosure. For a better understanding of the Elastic Hair Tie Dispenser, its operating advantages and the specific advantages attained by its uses, reference should be made to the accompanying drawings and descriptive matter in which there are illustrated preferred embodiments of the Elastic Hair Tie Dispenser.

The preferred embodiment of this Elastic Hair Tie Dispenser will be a small round flat device that can easily fit into the palm of one hand and will cut the replaceable elastic cording within a fabric sleeve by pressing the pivoting blade actuator with the thumb cutting it to any desired length. The device consists of a right hand and left hand transparent sections that can be attached by the means of screws, fasteners or permanently attached so that it will not be refillable, but rather sold as a disposable unit. By being transparent, the dispenser unit shows the replaceable elastic cording within the attractive colors of fabric sleeve between the two halves of the device. The elastic cording will be available in a round or square shape and a wide variety of bright colors.

The elastic cording is cut by the means of a blade attached to the pivoting blade actuator that automatically retracts after cutting the elastic cording. When finger guides on both sides of the two halves of the transparent sections moves within the cavities between the two spring back fingers of the pivoting blade actuator, it rotates on bosses that are on the outside of the transparent sections. A polyurethane cutting pad is sealed within the right hand and left hand transparent sections to cushion the blade edge. A flexible cover exposes the pivoting blade actuator and protects the person using the device from being cut by the cutting blade.

With respect to the above description then, it is to be realized that the optimum dimensional relationships for the parts of the Elastic Hair Tie Dispenser, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present design. Therefore, the foregoing is considered as illustrative only of the principles of the Elastic Hair Tie Dispenser. Further, since numerous modifications and changes will readily occur to those skilled in the art, it is not desired to limit the device to the exact construction and operation shown and described, and accordingly, all suitable modifications and equivalents may be resorted to, falling within the scope of the Elastic Hair Tie Dispenser application.

BRIEF DESCRIPTION OF THE DRAWINGS

The accompanying drawings, which are incorporated in and form a part of this specification, illustrate embodiments of the Elastic Hair Tie Dispenser and together with the description, serve to explain the principles of this device.

FIG. 2 depicts the replaceable elastic hair tie material comprising rubber cording within a fabric sleeve, coming in a variety of different colors, shown here packaged for sale and distribution in a zip lock plastic bag packaging, or the like.

As required, detailed embodiments of the present Elastic Hair Tie Dispenser are disclosed herein, however, it is to be understood that the disclosed embodiments are merely exemplary of the design that may be embodied in various forms. Therefore, specific functional and structural details disclosed herein are not to be interpreted as limiting, but merely as basic for the claims and as a representative basis for teaching one skilled in the art to variously employ the present Elastic Hair Tie Dispenser in virtually any appropriately detailed structure.

DETAILED DESCRIPTION OF THE PREFERRED EMBODIMENTS

Figure 1:
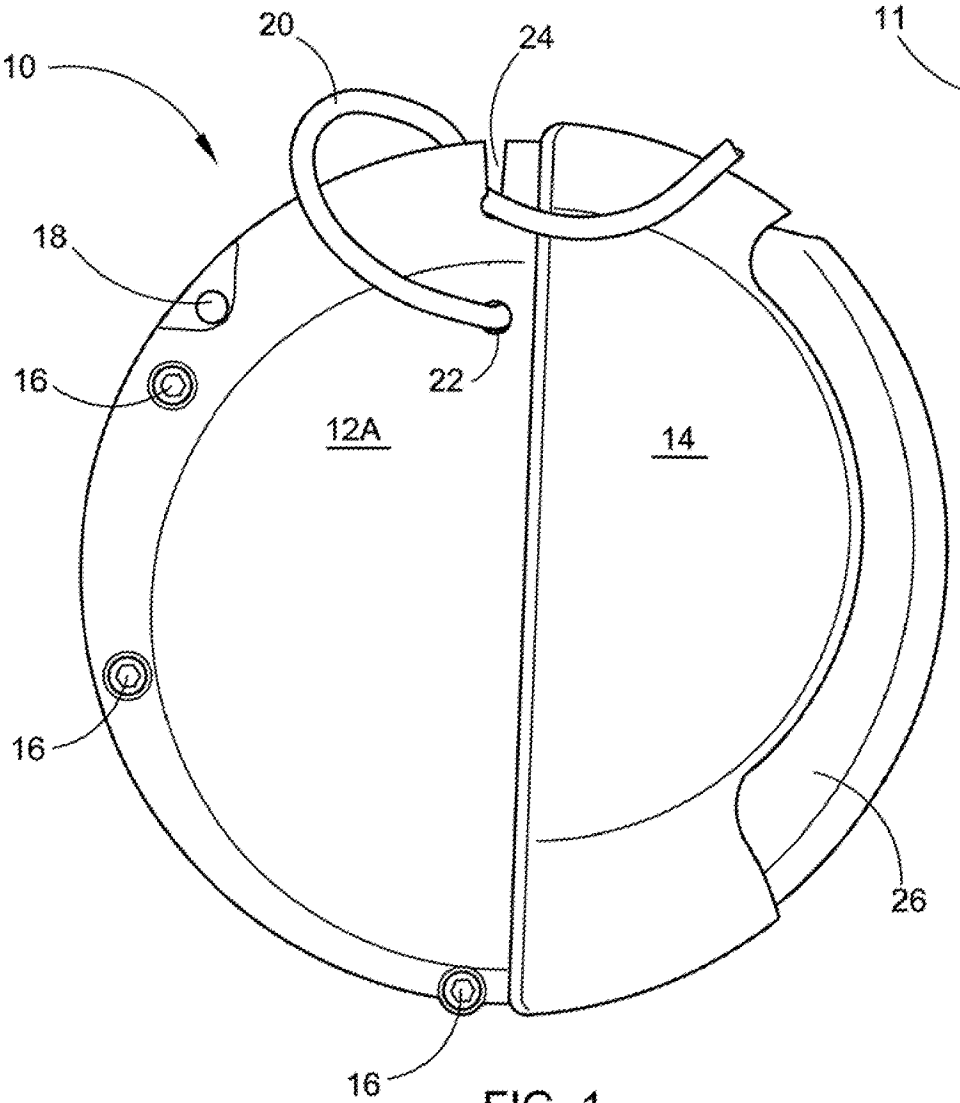
FIG. 1 depicts an assembled view of the Elastic Hair Tie Dispenser.

Referring now to the drawings, wherein similar parts of the Elastic Hair Tie Dispenser 10 are identified by like reference numerals, there is seen in FIG. 1 an assembled view of the Elastic Hair Tie Dispenser 10, illustrating the left side transparent section 12A being held together with screws 16. A lanyard orifice 18 is on the edge of the device with the replaceable elastic cording within a fabric sleeve 20 coming out of cording orifice 22 and wrapped around through the cutting slot 24. The flexible safety cover 14 houses the pivoting blade actuator 26.

Figure 2:
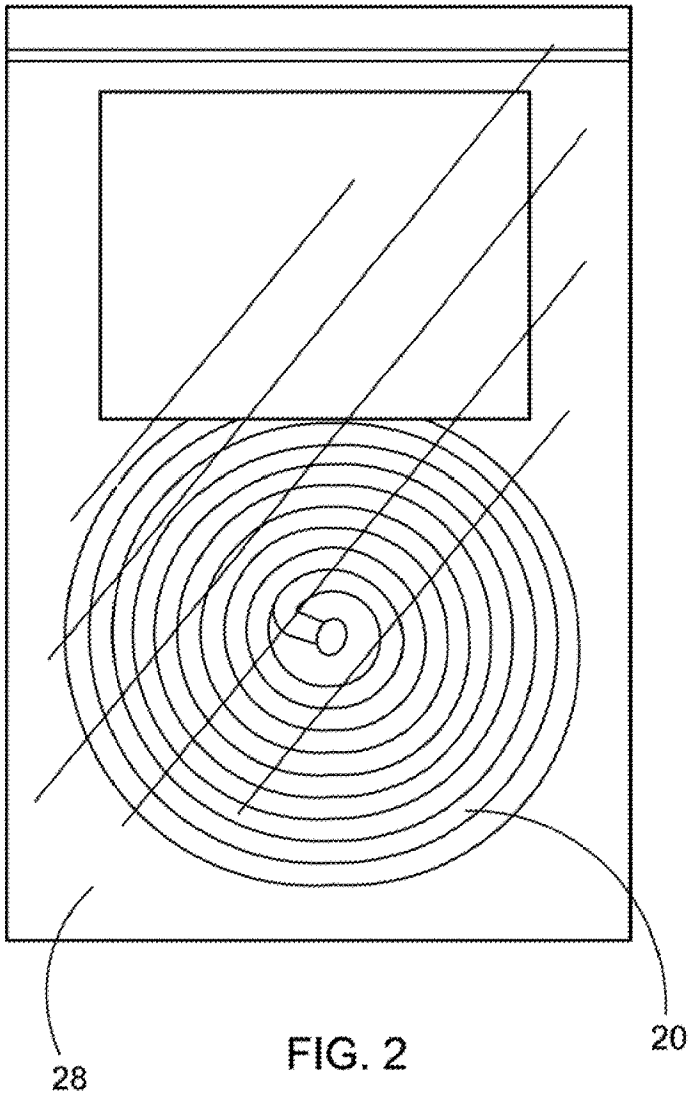

FIG. 2 depicts one type of retail packaging option 11 including the replaceable elastic cording within a fabric sleeve 20, coming in a variety of different colors in a zip lock plastic bag 28, packaging or the like. The elastic hair tie material is constructed of an elastomer core center which comprises 90% rubber compound, 5% color added and 5% solvents and releasing agents used in manufacture. Most typically, the rubber compound is 95% to 100% natural or synthetic rubber. The elastomer core center may also be manufactured in a variety of colors and shapes. The overall finished diameter of the product, sold in strands of varying lengths to be refillable into the Elastic Hair Tie Dispenser, is about 3 millimeters, with the elastomer core center being about 2 millimeters in diameter. The elastomer core center has an elasticity ratio of 1 to 4, that is, a 10-inch length will be stretchable to 40 inches. This combination of elastic hair tie material and the Elastic Hair Tie Dispenser enables a user to custom cut hair tie material to any desired length for any desired purpose, for any hair type or any application.

The elastomer core center cut to a length of a user desired hair tie, can come in a round or square configuration and stretch four times its original length. The elastomer core center has a cord covering of a pliable nylon yarn material available in many colors. The average thickness of the outer pliable nylon yarn material is 1 millimeter. This outer pliable nylon yarn also has an elasticity ration of 1 to 4.

Figure 3:
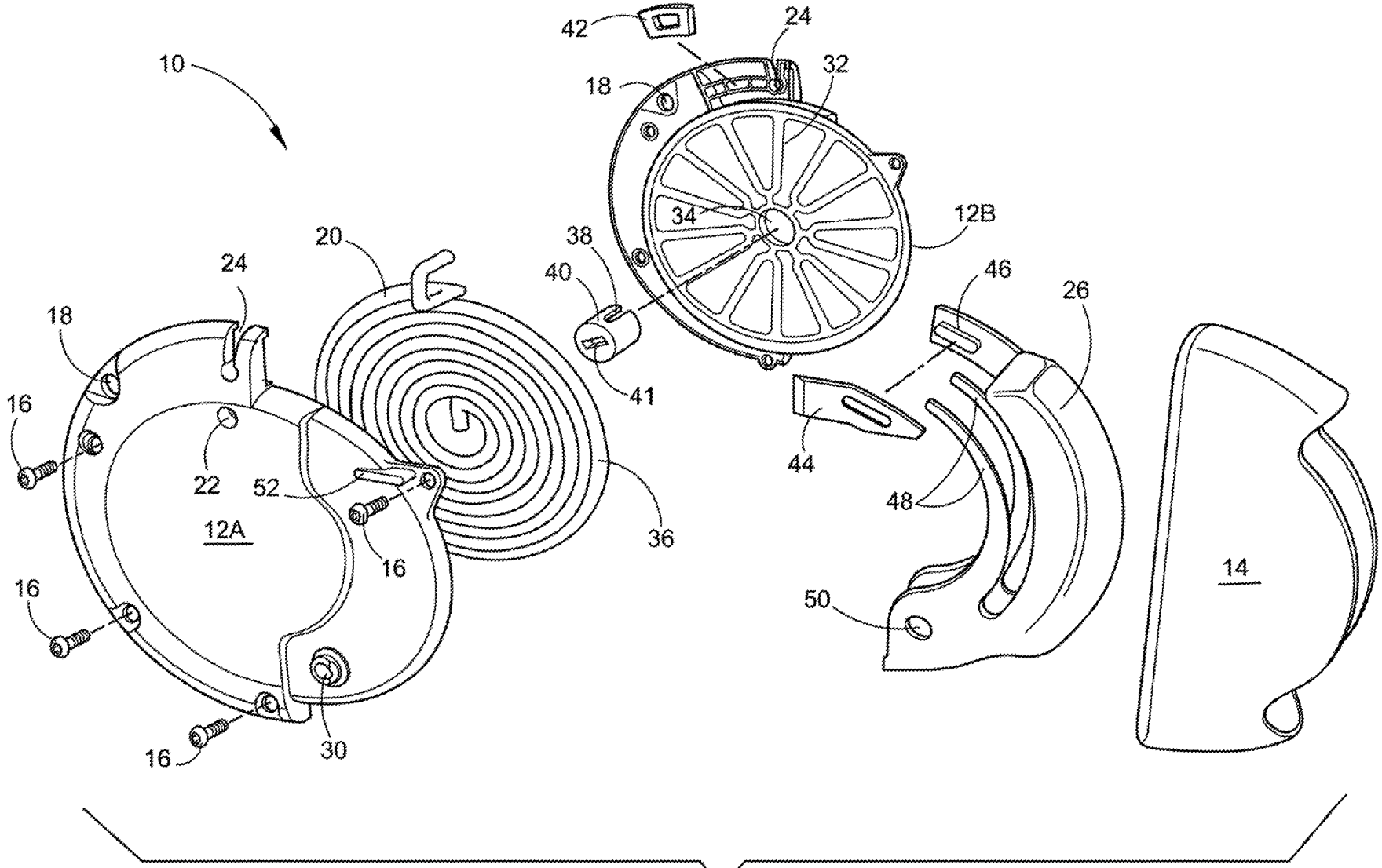
FIG. 3 depicts an exploded perspective view of the Elastic Hair Tie Dispenser.

FIG. 3 depicts an exploded perspective view of the Elastic Hair Tie Dispenser 10 with the left side transparent section 12A and the right side transparent section 12B to be held together with screws 16. Other methods of attaching the left side transparent section 12A and the right side transparent section 12B may be used as a means to attach them together and will still be covered within the scope of this application.

A lanyard orifice 18, the cording orifice 22 the cutting slot 24 and the boss 30 for the pivoting blade actuator 26 are on the outside surfaces of the transparent sections 12A and 12B. The inside surface of transparent sections 12A and 12B are mirror images with structural ribs 32 and a spool orifice 34 that do not extend to the outside surface.

The replaceable elastic cording within a fabric sleeve 20 is in a coil 36 to be affixed through a slot 38 in the spool 40 that is held within the spool orifices 34 on the inside of the transparent sections 12A and 12B. A polyurethane cutting pad 42 is inserted between the left side transparent section 12A and the right side transparent section 12B and works as a cushion for the cutting blade 44.

A pivoting blade actuator 26 has a cutting blade 44 attachment section 46 and two spring back fingers 48 are a unique means with their flexibility to retract the cutting blade 44 while the unit is pivoting on boss 30 in orifices 50. It is directed in both ways by the means of the finger guides 52 on the outside surfaces of the transparent sections 12A and 12B after pressure has been applied to the blade actuator 26. The flexible safety cover 14 houses the pivoting blade actuator 26.

Figure 4:
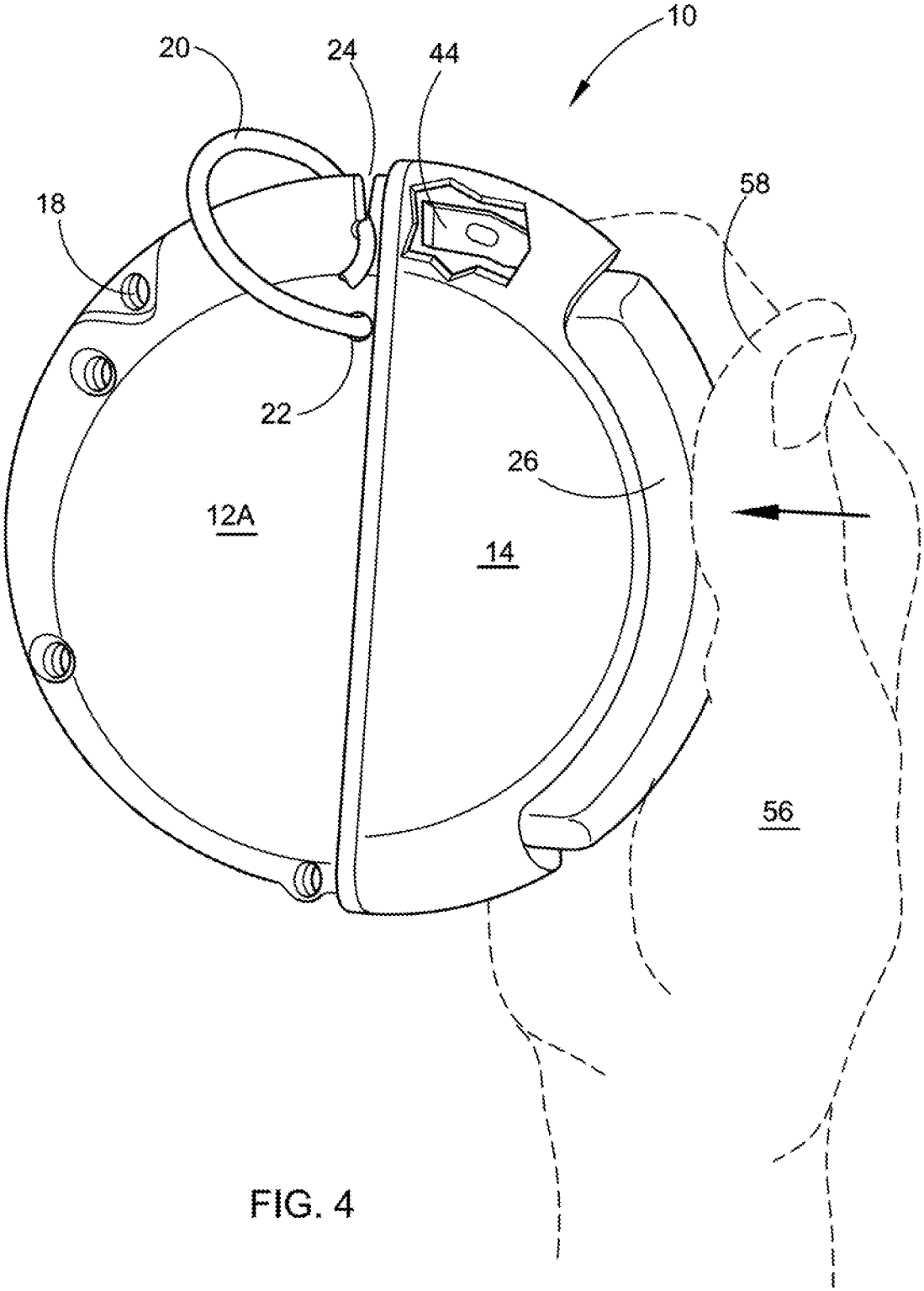
FIG. 4 depicts a perspective view of a hand holding the Elastic Hair Tie Dispenser with a hand holding it and a user pressing with the thumb to actuate the blade to cut the replaceable elastic cording.

FIG. 4 depicts a perspective view of a hand 56 holding the Elastic Hair Tie Dispenser 10 with the thumb 58 pressing the pivoting blade actuator 26 to cut the replaceable elastic cording 20 with the cutting blade 44.

Figure 5:
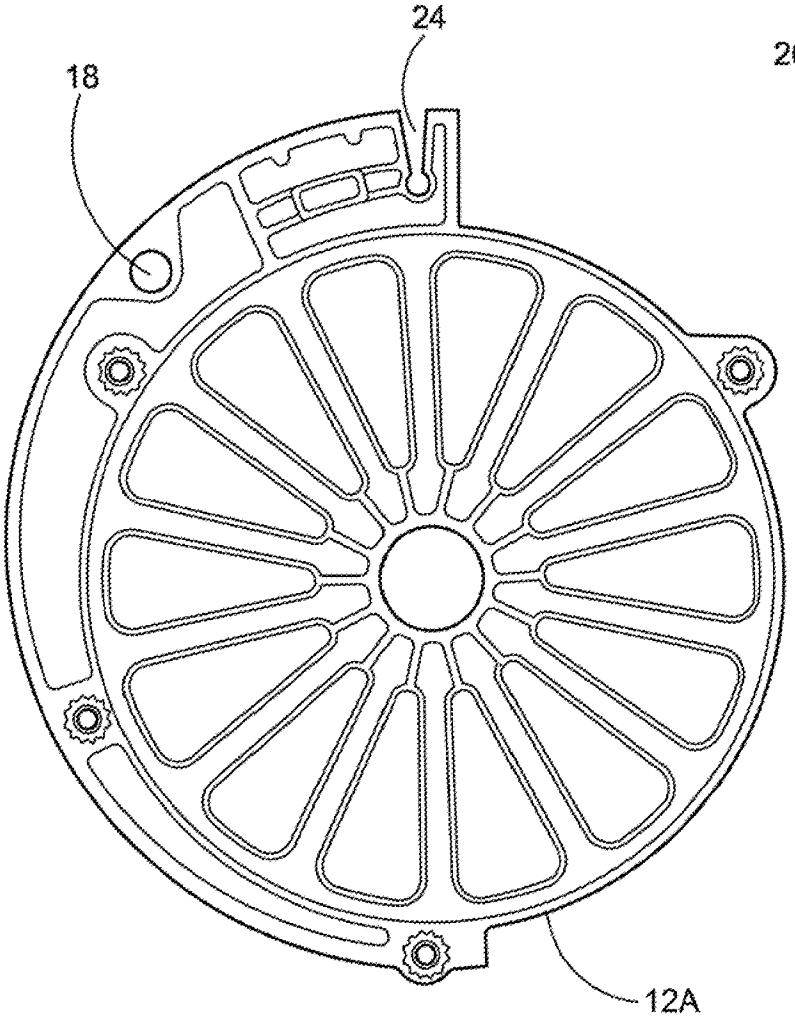
FIG. 5 depicts a left side view of the interior of the transparent section of the Elastic Hair Tie Dispenser.

FIG. 5 depicts a left side view of the interior of the transparent section of the Elastic Hair Tie Dispenser 12A.

Figure 6:
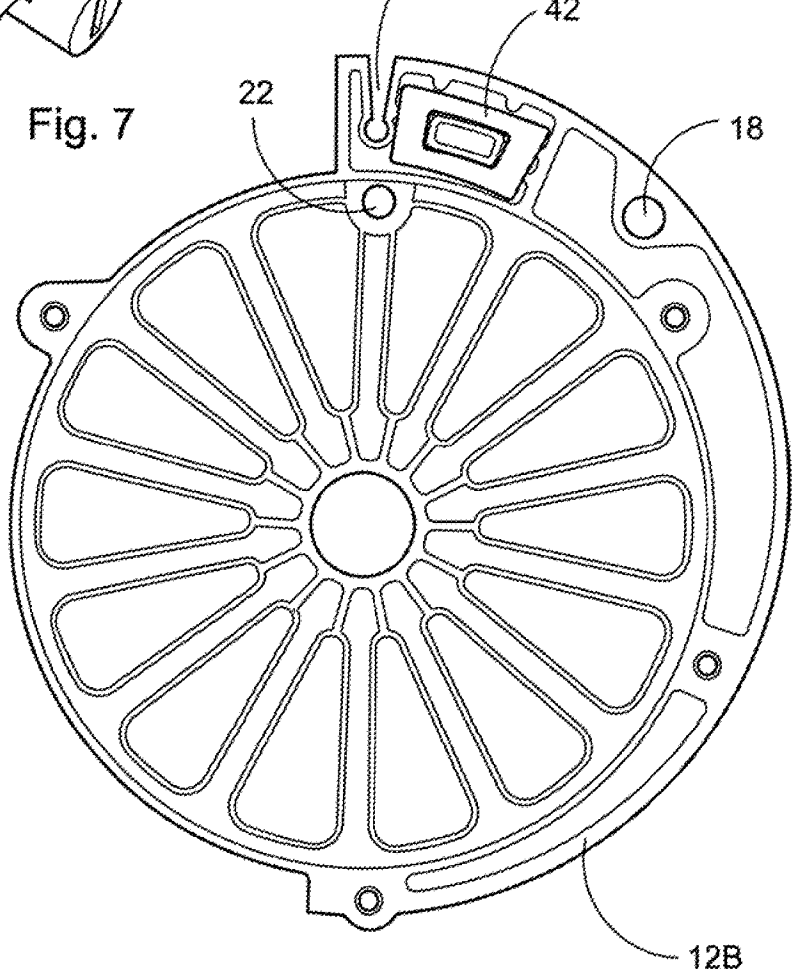
FIG. 6 depicts a right-side view of the interior of the transparent section of the Elastic Hair Tie Dispenser.

FIG. 6 depicts a right-side view of the interior of the transparent section of the Elastic Hair Tie Dispenser 12B with the cutting pad 42 in place.

Figure 7:
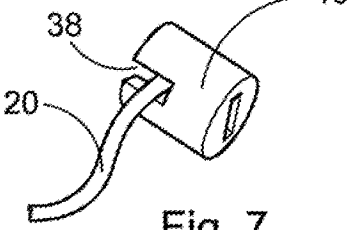
FIG. 7 depicts a perspective view of the spool element.

FIG. 7 depicts a perspective view of the spool 40 with the replaceable elastic cording 20 going through the slot 38.

Figure 8:
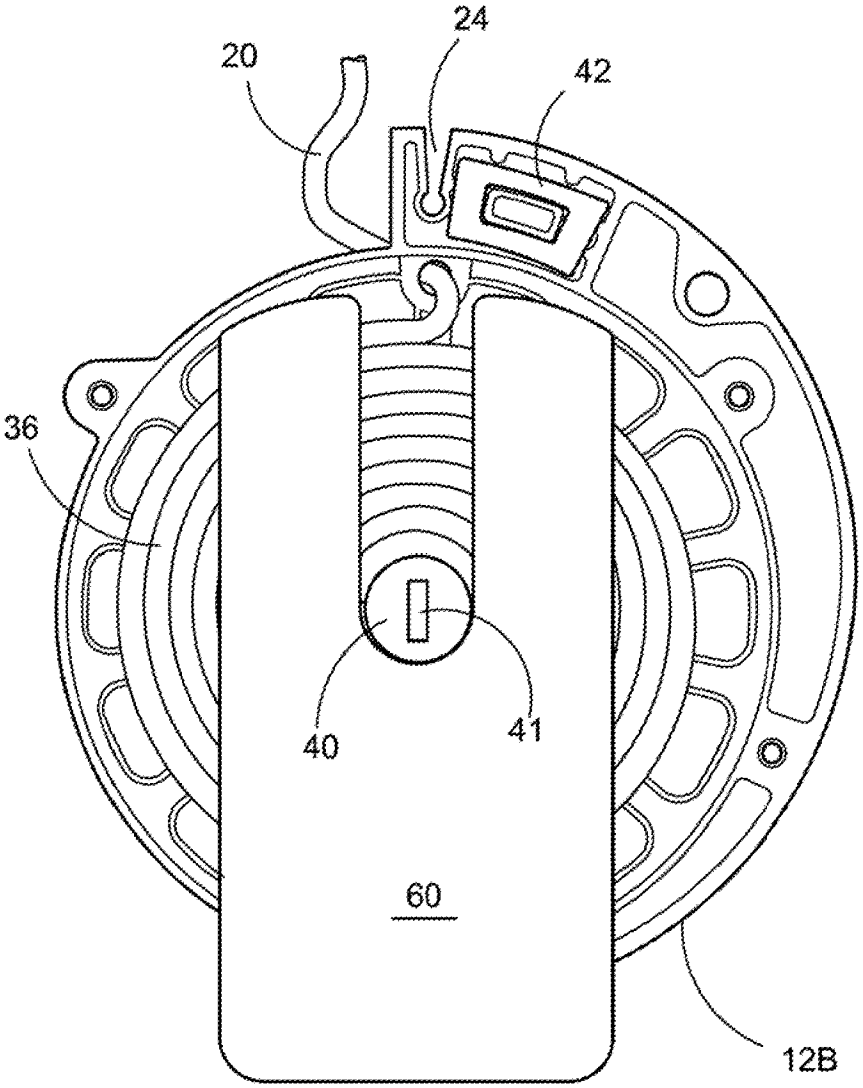
FIG. 8 depicts a side view of the right side of the transparent section of the Elastic Hair Tie with the winding tool for the replaceable elastic cording over the spool.

FIG. 8 depicts a side view of the right side of the transparent section of the Elastic Hair Tie Dispenser 12B with the winding tool 60 for the replaceable elastic cording 20 over the spool 40. By placing a small flathead screw driver in the slot 41 and rotating it, the replaceable elastic cording 20 is drawn in and formed into the coil 36.

Figure 9:
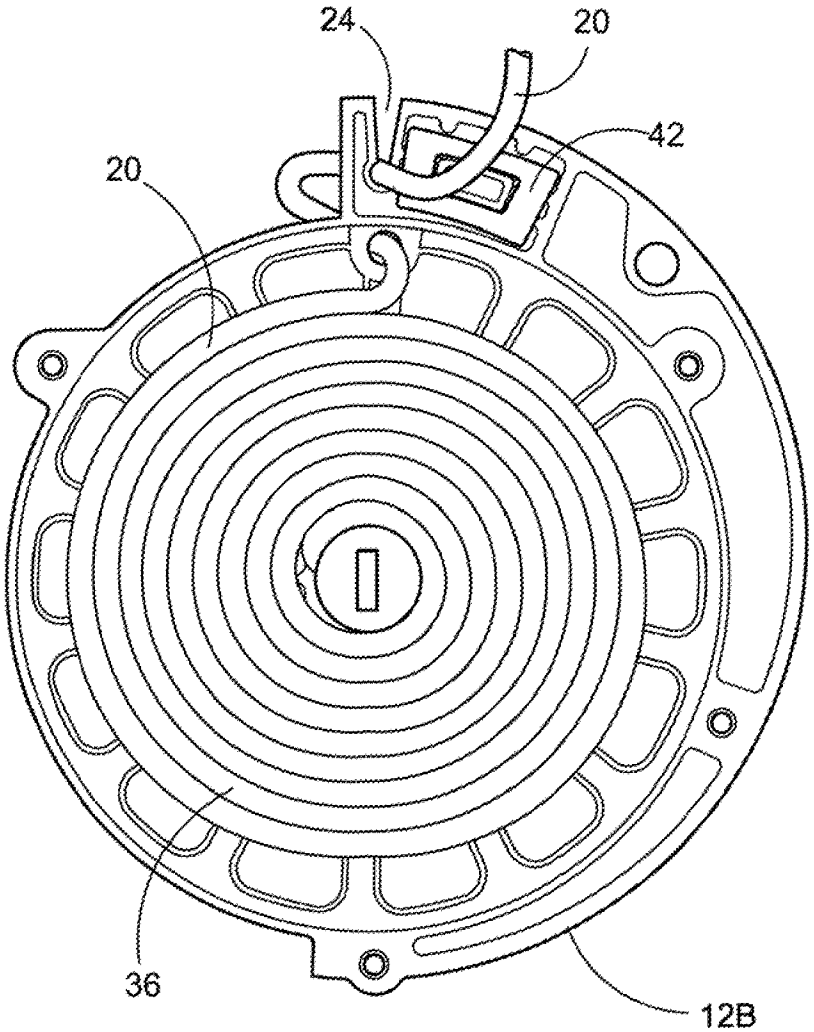
FIG. 9 depicts a side view of the right side of the transparent section of the Elastic Hair Tie with replaceable elastic cording fed through the cutting slot.

FIG. 9 depicts a side view of the right side of the transparent section of the Elastic Hair Tie Dispenser 12B with replaceable elastic cording 20 fed through the cutting slot 38.

Figure 10:
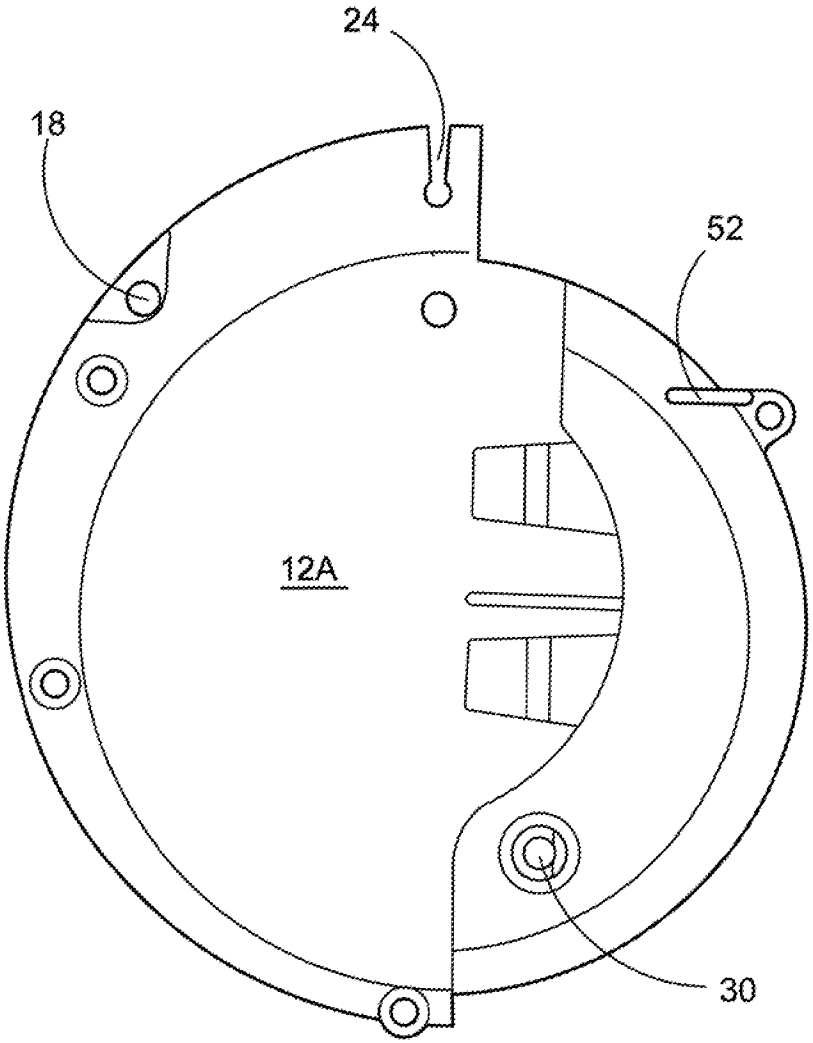
FIG. 10 depicts an exterior side view of the transparent section of the Elastic Hair Tie Dispenser.

FIG. 10 depicts an exterior side view of the left side transparent section 12A of the Elastic Hair Tie Dispenser 10 illustrating the location of the finger guide 52 for the spring back fingers 48 on the pivoting blade actuator 26.

Figure 11:
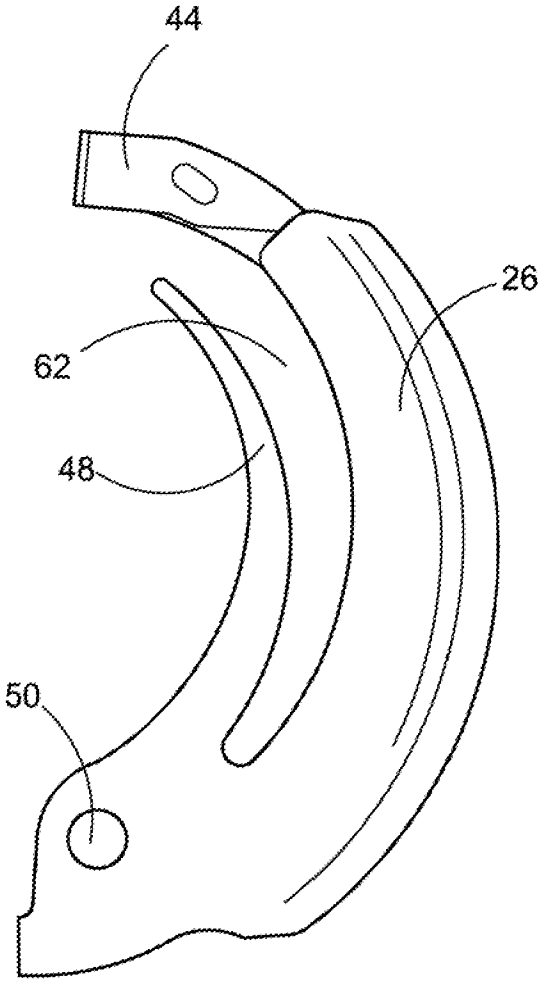
FIG. 11 depicts side view of the pivoting blade actuator of the Elastic Hair Tie Dispenser.

FIG. 11 depicts side view of the pivoting blade actuator 26 of the Elastic Hair Tie Dispenser 10 and the cavity 62 where the finger guides 52 translate to give the spring action to pull back the cutting blade 44.

Figure 12:
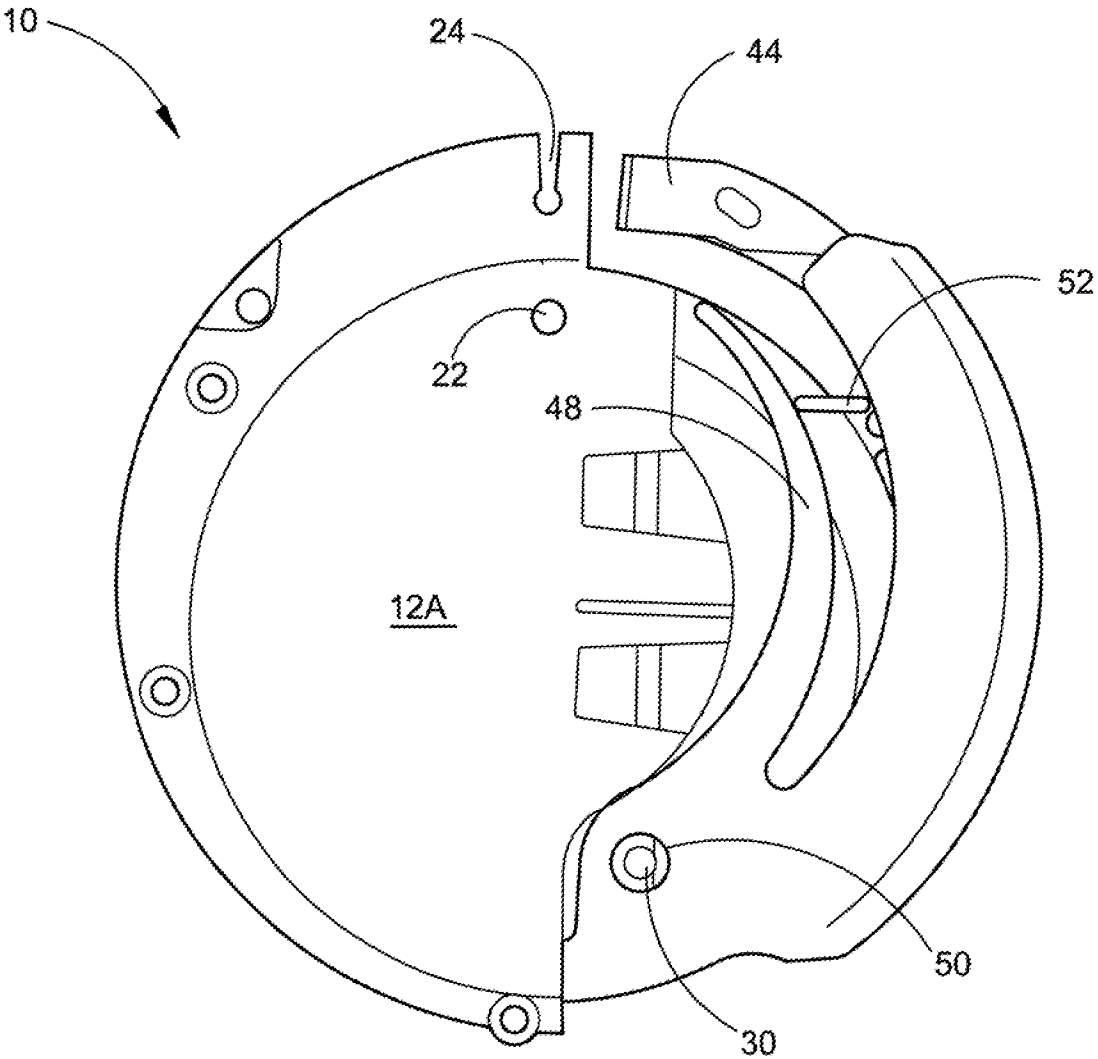
FIG. 12 depicts an assembled view of the pivoting blade actuator located on the transparent section of the Elastic Hair Tie Dispenser.

FIG. 12 depicts an assembled view of the pivoting blade actuator 26 (shown separated from the dispenser unit in FIG. 11) located on the transparent section 12A of the Elastic Hair Tie Dispenser 10 further clarifying the action and location of the cavity 62 where the finger guides 52 translate to give the spring action to pull back the cutting blade 44.

Figure 13:
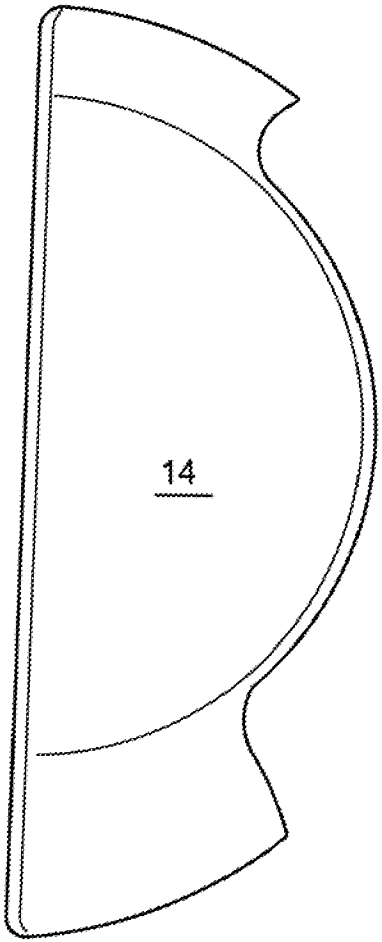
FIG. 13 depicts a side view of the flexible cover of the Elastic Hair Tie Dispenser.

FIG. 13 depicts a side view of the flexible safety cover 14 of the Elastic Hair Tie Dispenser 10.

The Elastic Hair Tie Dispenser 10 shown in the drawings and described in detail herein disclose arrangements of elements of particular construction and configuration for illustrating preferred embodiments of structure and method of operation of the present design. It is to be understood, however, that elements of different construction and configuration and other arrangements thereof, other than those illustrated and described may be employed for providing an Elastic Hair Tie Dispenser 10 in accordance with the spirit of this invention, and such changes, alternations and modifications as would occur to those skilled in the art are considered to be within the scope of this application as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A method for making an elastic hair tie dispenser, comprising the steps of:

a) providing two round transparent clamshell housing sections configured to be held together with fasteners, wherein when assembled said two housing sections form a dispenser housing configured to accept a centrally located spool and a cutting blade;

b) providing elastic hair tie cording material removably wound around said spool forming a coil within said assembled dispenser housing; and c) providing a cording orifice and a cutting slot molded into said dispenser housing; and d) providing a pivoting blade actuator assembly movably attached to said dispenser housing having a cutting blade therein;

whereby said elastic hair tie cording spooled within said housing is dispensed by being pulled through said cording orifice to a variable desired length then cut with said pivoting blade actuator cutting blade.

2. The method of making an elastic hair tie dispenser according to claim 1, wherein said elastic hair tie cording material removably wound around said spool forming a coil within said assembled dispenser housing includes an elastomer core center which comprises 90% rubber compound, 5% color added and 5% solvents and releasing agents used in manufacture, and has an elasticity ratio of 4:1.

3. The method of making an elastic hair tie dispenser according to claim 1, wherein said pivoting blade actuator assembly includes a blade attachment portion capable of accepting a removable replaceable cutting blade, spring back fingers and an orifice for pivotably mounting on said dispenser housing, whereby when in operation, the pivoting blade actuator assembly is forced forward by a user, said cutting blade cuts said elastic hair tie cording material dispensed into any desired length by a user, and springs back to be in position to cut again.

4. The method of making an elastic hair tie dispenser according to claim 1, wherein said dispenser housing includes a cutting pad accepting section wherein a cutting pad is mounted and further wherein when said cutting blade is actuated using said pivoting blade actuator assembly, said cutting blade moves to cut said hair tie material and stops on said cutting pad working as a cushion for the cutting blade.

5. The method of making an elastic hair tie dispenser according to claim 1, further including a removeable pivoting blade assembly safety cover wherein said safety cover attaches to said dispenser housing by snapping on to said dispenser housing and prevents the blade from unwanted exposure or actuation cutting motion when attached.

6. The method of making an elastic hair tie dispenser according to claim 1, wherein said centrally located spool is rotatably affixed to said dispenser housing and includes a hair tie material fastening slot and an external slot, wherein said hair tie material coiled within said housing is fastened to said spool, and a user can coil hair tie material back into said dispenser housing by winding said hair tie material using a screwdriver positioned within said external slot, thereby obtaining any desired length of hair tie material to be cut and subsequently used.

7. The method of making an elastic hair tie dispenser according to claim 1, wherein said elastic hair tie cording material is sold separately as an individual coil package and can be inserted into said dispenser housing by disassembling said housing, thereby refilling said dispenser housing with a coil of elastic hair tie cording material.

8. The method of making an elastic hair tie dispenser according to claim 1, wherein said elastic hair tie cording material is sold separately as an individual coil package and can be inserted into said dispenser housing by attaching a length of elastic cording hair tie material to said spool and winding said elastic hair tie material into said dispenser housing and onto said spool using said external slot to rotate said spool.

9. The method of making an elastic hair tie dispenser according to claim 2, wherein said elastic hair tie cording material removably wound around said spool forming a coil within said assembled dispenser housing includes an elastomer core center which comprises 90% rubber compound, 5% color added and 5% solvents and releasing agents used in manufacture, and has an elasticity ratio of 4:1, and further wherein said elastomer core center is covered by fabric of varying colors.

10. The method of making an elastic hair tie dispenser according to claim 1, wherein said dispenser housing further includes a lanyard orifice for attaching a lanyard.

11. An elastic hair tie dispenser, comprising:

a) two round transparent clamshell housing sections configured to be held together with fasteners, wherein when assembled said two housing sections form a dispenser housing configured to accept a centrally located spool and a cutting blade;

b) elastic hair tie cording material removably wound around said spool forming a coil within said assembled dispenser housing, wherein said elastic hair tie cording material includes an elastomer core center which comprises 90% rubber compound, 5% color added and 5% solvents and releasing agents used in manufacture, and has an elasticity ratio of 4:1;

c) a cording orifice and a cutting slot molded into said dispenser housing;

d) a pivoting blade actuator assembly movably attached to said dispenser housing having a cutting blade therein, wherein said pivoting blade actuator assembly includes a blade attachment portion capable of accepting a removable replaceable cutting blade, spring back fingers and an orifice for pivotably mounting on said dispenser housing, whereby when in operation, the pivoting blade actuator assembly is forced forward by a user, said cutting blade cuts said elastic hair tie cording material dispensed into any desired length by a user, and springs back to be in position to cut again; and e) a removeable pivoting blade assembly safety cover wherein said safety cover attaches to said dispenser housing by snapping on to said dispenser housing and prevents the blade from unwanted exposure or actuation cutting motion when attached;

whereby said elastic hair tie cording spooled within said housing is dispensed by being pulled through said cording orifice to a variable desired length then cut with said pivoting blade actuator cutting blade, wherein said centrally located spool is rotatably affixed to said dispenser housing and includes a hair tie material fastening slot and an external slot, wherein said hair tie material coiled within said housing is fastened to said spool, and a user can coil hair tie material back into said dispenser housing by winding said hair tie material using a screwdriver positioned within said external slot, thereby obtaining any desired length of hair tie material to be cut and subsequently used, and wherein said elastic hair tie cording material is sold separately as an individual coil package and can be inserted into said dispenser housing.

12. The elastic hair tie dispenser according to claim 11, wherein said dispenser housing includes a cutting pad accepting section wherein a cutting pad is mounted and further wherein when said cutting blade is actuated using said pivoting blade actuator assembly, said cutting blade moves to cut said hair tie material and stops on said cutting pad working as a cushion for the cutting blade.

13. The elastic hair tie dispenser according to claim 11, wherein said elastic hair tie cording material can be inserted into said dispenser housing by disassembling said housing, thereby refilling said dispenser housing with a coil of elastic hair tie cording material.

14. The elastic hair tie dispenser according to claim 11, wherein said elastic hair tie cording material can be inserted into said dispenser housing by attaching a length of elastic cording hair tie material to said spool and winding said elastic hair tie material into said dispenser housing and onto said spool using said external slot to rotate said spool.

15. The elastic hair tie dispenser according to claim 11, wherein said elastomer core center is covered by fabric of varying colors.

16. The elastic hair tie dispenser according to claim 11, wherein said dispenser housing further includes a lanyard orifice for attaching a lanyard.

* * * * *